United States Patent [19]

Pin

[11] Patent Number: 4,860,463

[45] Date of Patent: Aug. 29, 1989

[54] FOOTWEAR HAVING VENTILATION AND SHOCK-ABSORBING PROPERTIES

[76] Inventor: Huang Pin, P.O. Box 10160, Taipei, Taiwan

[21] Appl. No.: 238,133

[22] Filed: Aug. 30, 1988

[51] Int. Cl.[4] ..... A43B 7/06

[52] U.S. Cl. ..... 36/3 B; 36/3 R; 36/29

[58] Field of Search ..... 36/3 B, 3 R, 29, 35 B

[56] References Cited

U.S. PATENT DOCUMENTS

| | | | |
|---|---|---|---|
| 1,932,557 | 10/1933 | Meucci | 36/3 R |
| 3,475,836 | 11/1969 | Brahm | 36/3 B |
| 4,185,402 | 1/1980 | Digate | 36/3 B |
| 4,633,597 | 1/1987 | Shiang | 36/3 B |
| 4,654,982 | 4/1987 | Lee | 36/3 B |

FOREIGN PATENT DOCUMENTS

| | | | |
|---|---|---|---|
| 2631370 | 1/1978 | Fed. Rep. of Germany | 36/3 B |

*Primary Examiner*—Werner H. Schroeder
*Assistant Examiner*—D. Biefeld

[57] ABSTRACT

A footwear includes a sole having a rear socket, a middle transverse ventilation channel, and a plurality of front longitudinal ventilation channels fluidically communicated with a wearer's toe portions, an elastic pad having a plurality of longitudinal holes or elastic tubes formed in the rear socket of the sole, an upper cover covering the sole having a filter formed on a front toe portion of the upper cover, and an inner sole having a plurality of perforations in the front toe portion, so that the elastic pad may serve as a pump for sucking air from the wearer's toe portions, through the perforations of inner sole, the filter of upper cover and the longitudinal channels in the sole and for discharging the air through the transverse channel towards an environment, and the elastic pad may also serve as a shock absorber during sporting or jogging uses.

7 Claims, 2 Drawing Sheets

FOOTWEAR HAVING VENTILATION AND SHOCK-ABSORBING PROPERTIES

BACKGROUND OF THE INVENTION

Perona disclosed a ventilated shoe in French Patent No. 826,665 as having a rear tube 7 and a bottom tube 6 provided for ventilating air in a shoe. However, there is only a ventiltaed tube. There is no provision for any check valve therein so that its ventilation effect is quite limited.

Sandmeier disclosed a removable inner sole for footwear in his U.S. Pat. No. 4,215,492 having an interior chamber for the forced flow of air between the heel and toe portions and through inlet and outlet openings. However, the pumping chamber 18 as formed by the upper member 12, lower member 14 and the spacer 24 is a void interior space without being filled with any cushioning material so that Sandmeier's footwear is not satisfactory for serving as a shock absorbing shoe for sporting or jogging purposes.

The present inventor has found the drawbacks of the conventional footwears and invented the present footwear having ventilation and shock-absorbing effects.

SUMMARY OF THE INVENTION

The object of the present invention is to provide a footwear including a sole having a rear socket formed in a heel portion of the sole and a plurality of ventilation channels formed in a front toe portion thereof, an elastic pad formed with a plurality of longitudinal holes therein inserted into the rear socket of the sole, an upper cover sealingly formed on the upper surface of the sole, and an inner sole embedded on the upper cover, whereby upon a depression by a wearer's foot on the elastic pad, the hot dirty air sucked from a wearer's toe portion will be compressed and discharged through outlet ports formed through the sole, and the elastic pad will also serve as a shock absorber or buffer for preventing sporting injury.

DETAILED DESCRIPTION

Figure 1:
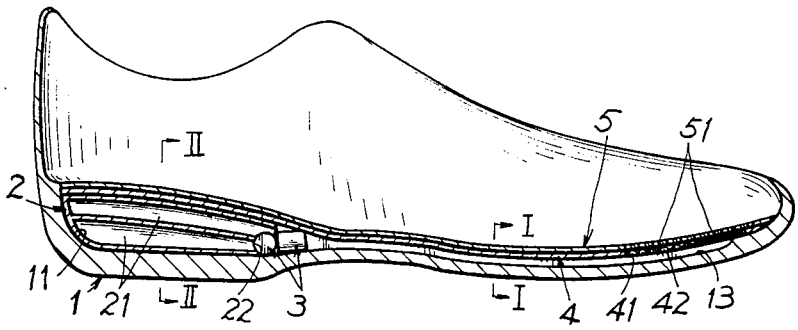
FIG. 1 is a sectional elavation drawing of the present invention.

As shown in the figures, the present invention comprises: a sole 1, an elastic pad 2 inserted in a heel portion of the sole 1, a plurality of check valves 3 formed in a plurality of air ventilation channels formed in the sole, an upper cover 4 sealingly formed on an upper periphery of the sole 1, and an inner sole 5 embedded on the cover 4.

The sole 1 includes: a rear socket 11 formed in a heel portion of the sole 1 for inserting the elastic pad 2 therein, a transverse ventilation channel 12 transversely formed in a middle portion of sole 1 in front of the rear socket 11, and a plurality of longitudinal ventilation channels 13 formed in a front portion of the sole 1.

The rear socket 11 may be further recessed with several grooves 111 for engaging he corresponding extensions 20 formed on the pad 2 for a stable combination of the pad 2 with the sole 1.

Each longitudinal ventilation channel 13 includes a rear port 131 fluidically communicated with the transverse ventilation channel 12 and a front port 132 fluidically communicated with a wearer's toe portions.

Figure 2:
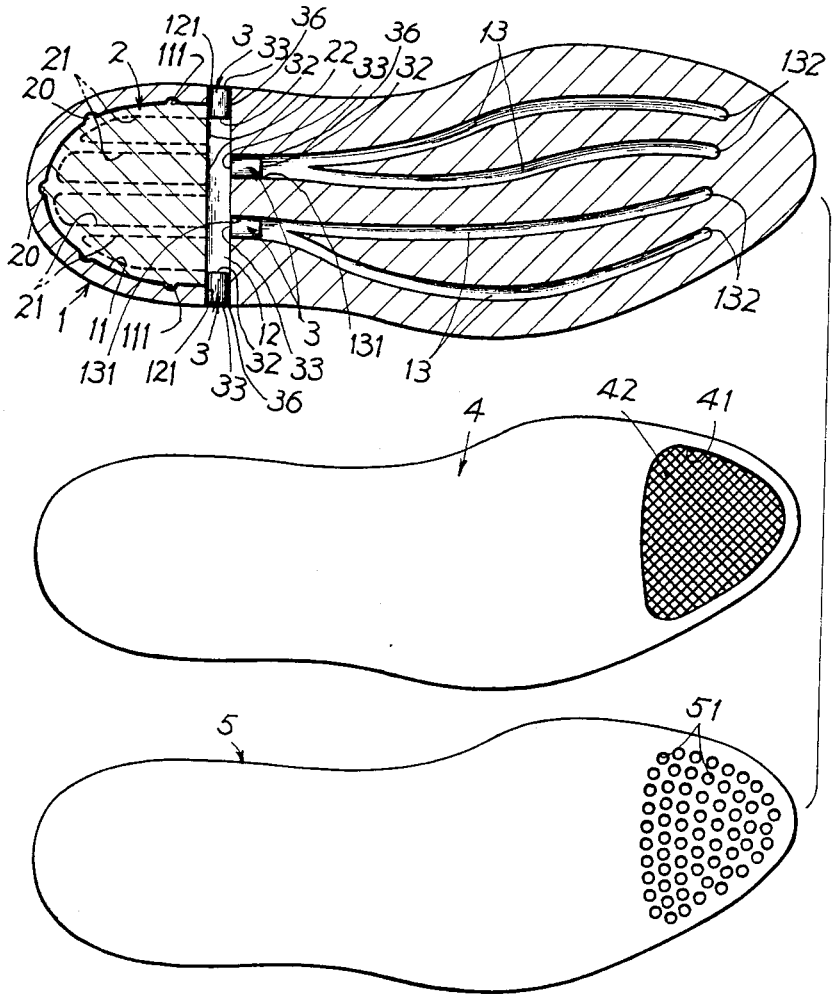
FIG. 2 is a top-view illustration showing all of the elements in the construction of the present invention.

A pair of check valves 3 are respectively provided on two discharge ports 121 on two opposite ends of the transverse channel 12 to allow a one-way air discharge therethrough. Several longitudinal ventilation channels 13 have their rear ports 131 formed together for commonly inserting a check valve 3 such as shown in FIG. 2 to save production cost therefor. Naturally, each rear port 131 of each longitudinal channel 13 may have an individually inserted check valve 3 therein. The check valve 3 provided in the rear port 132 of the longitudinal channel 13 should be positioned to allow a one-way suction of air flow from the front port 132, but to preclude a back flow of air into the channels 133 when compressing the pad 2.

The elastic pad 2 is formed with a plurality of longitudinal holes 21 therein. Each hole 21 is closed in its innermost end and opened in its outer end to communicate with the transverse channel 12. The pad 2 is made by a integral molding process and may be made of rubber or plastic elastomer materials. The elastic pad 2 may also be substituted with a plurality of hollow elastic tubes (not shown) overlapped and inserted in the socket 11 of sole 1 each tube having an innermost closed end and having an outermost opening communicated with the transverse channel 12.

Figure 6:
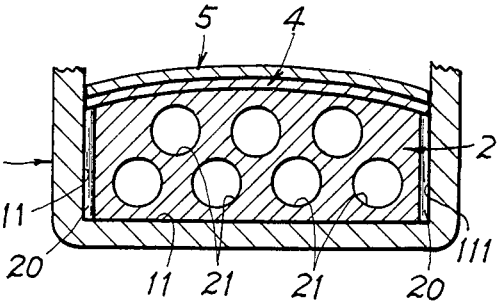
FIG. 6 is a cross sectional illustration of the present invention as viewed from II—II direction of FIG. 1.
Figure 7:
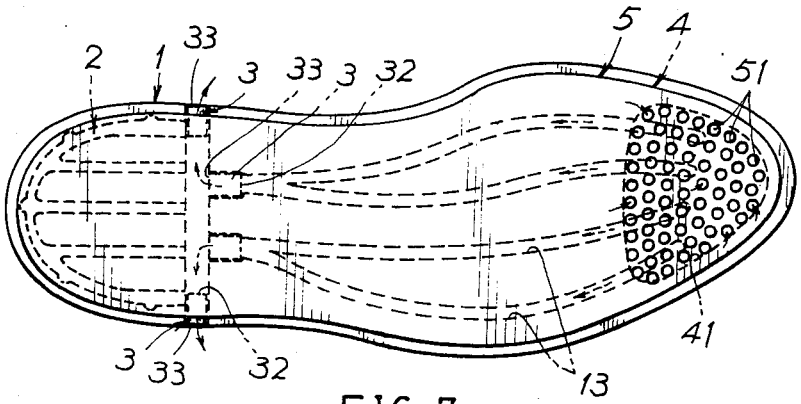
FIG. 7 is an illustration showing a ventilation effect of the present invention.

The arrangement of the longitudinal holes 21 as shown in FIG. 6 is preferably made in that the upper holes are interlacedly laid above the lower holes to allow each upper hole to be not projectively aligned with its corresponding lower hole to have a stable configuration for normally supporting a wearer's weight. The plural holes 21 form a pumping chamber for the present invention.

Figure 3:
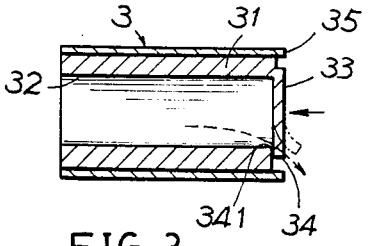
FIG. 3 is a sectional drawing of a check valve of the present invention.
Figure 4:
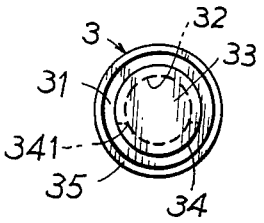
FIG. 4 is a side view of the check valve of the present invention.
Figure 5:
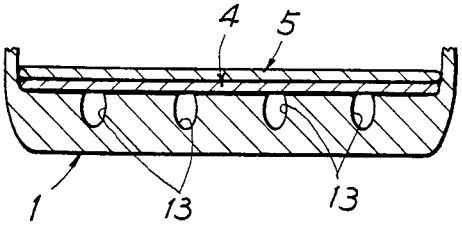
FIG. 5 is a cross sectional illustration of the present invention as viewed from I—I direction of FIG. 1.

The check valve 3 as shown in FIGS. 3 and 4 includes an elastic cylindrical member 31 having an inlet opening 32 formed on its one end and a resilient lid 34 formed on an end cover 33 opposite to the opening 32, and a protection sleeve 35 circumferentially disposed around the cylindrical member 31 made of rigid material for preventing collapse of the valve member 31. The resilient lid 34 may be formed by cutting a slit 341 on a partial periphery of the end cover 33 to form a discharge opening of the check valve 3. The lid 34 is opened outwardly by an air flow passing through the opening 32 and will be resiliently recovered to close the discharge opening 341 of the valve 3 when the air pressure inside the valve is released. Other styles of check valve 3 of this invention may be modified by those skilled in the art. The lid 34 may have a height of one third of the diameter of cover 33.

The check valve 3 as installed in the rear port 131 of the longitudinal ventilation channel 13 may be deemed as an inlet valve and the check valve 3 provided in the discharge port 121 of the transverse channel 12 may be deemed as an outlet valve of the pumping chamber defined by the plural longitudinal holes 21 of the pad 2.

The upper cover 4 has a shape equivalent to that of the sole 1 and is provided with a filter 42 on a front opening 41 of cover 4 correpsonding to the toe portion of a wearer's foot and also corresponding to the front ports 132 of the longitudinal channels 13 of the sole 1, whereby upon an adhering of the upper cover 4 on the sole 1 for incorporating the pad 2 and check valves 3 in the relevant socket or ports in between the sole 1 and the cover 4, a forced ventilation system in a footwear is thus formed in this invention.

In order to enforce an air tightness of the air ventilation system of this invention, a sealant such as numeral 36 as shown in FIG. 2 may be provided between the sole 1 and the cover 4. The upper cover 4 should also be well sealed on the sole 1 for air tightness.

The inner sole 5 has a shape equivalent to that of sole 1 and cover 4 and is formed with a plurality of perforations 51 in a front portion of the inner sole 5 fluidically communicated with the filter 42 of cover 4 and the front ports 132 of ventilation channels 13 of sole 1, corresponding to a wearer's toe portions.

In using a footwear of the present invention, a depression formed by treading a wearer's foot on the heel portion of the shoe will compress the elastic pad 2 to squeeze the air inside the longitudinal holes 21 outwardly, whereby the air will then be discharged through the valves 3 provided in the discharge ports 121. The compressed air will close the check valves 3 or inlet valves as inserted in the rear ports 131 of the longitudinal ventilation channels 13 to allow a unique discharge direction through the transverse channel 12 and the two ports 121.

When lifting the wearer's foot above a ground floor, the depression on the elastic pad 2 is released and the elasticity of the pad 2 will restore itself to expand the longitudinal holes 21 to suck air from the perforations 51 of inner sole 5, filter 42 of cover 4 and front ports 132 of channels 13 of sole 1 to enter and inflate the holes 21 of the pad, ready for next depression operation.

The present invention has the following advantages superior to the conventional ventilation footwears:

1. The elastic pad 2 of this invention may play double roles both for ventilating the air inside a footwear and for serving as a shock absorber for preventing sporting injury since the air inside the holes 21 will not be suddenly released as the lid 34 only occupying one third of cover 33 thereby forming an air cushioning for the shoes.

2. The elastomer material besides the plurality of holes 21 of the pad 2 may provide a better elasticity or resilience for the pumping chamber of this invention to increase the speed of the ventilation "pumping" operation of the invention. Comparatively, Sandmeier's pump chamber 18 is merely a void space and once depressed the heel portion of the inner sole (sack) will be collapsed slowly and will also be slowly recovered since there is no restoring spring provided in his pump chamber 18.

3. The dirty, hot, stinking air is sucked from a front portion of a wearer's shoes and discharged through the ports 121 formed in sole 1 so that the unclean air is always discharged outwardly to the environment by the forced air circulation for comforting a wearer's foot or for hygienic purpose of the wearer.

The check valve 3 on transverse channel 12 is opened outwardly so as to preclude any water droplet enterring the channel 12.

I claim:

1. A footwear comprising:

a sole having a rear socket formed on a heel portion of the sole, a transverse ventilation channel transversely formed in the sole in front of the rear socket having two discharge ports formed through the sole on two opposite ends of the transverse channel, and a plurality of longitudinal ventilation channels formed in a front portion of said sole each longitudinal ventilation channel having a front port fludically communicated with a wearer's toe portions and a rear port fluidically communicated with said transverse ventilation channel;

an elastic pad having a plurality of longitudinal holes having front openings formed therein inserted in said rear socket of said sole, all front openings of said longitudinal holes communicated with said transverse ventilation channel;

a plurality of inlet valves provided in the rear ports of said longitudinal ventilation channels, each inlet valve being a check valve allowing a suction air flow through each said longitudinal channel to be discharged through said transverse channel and the discharge ports;

two outlet valves respectively provided on two discharge ports of the sole, each outlet valve being a check valve allowing an air flow discharge therethrough;

an upper cover having a filter formed on its front portion corresponding to said front ports of said longitudinal channels of said sole sealingly formed on an upper surface of said sole to form an air tight ventilation system of said longitudinal channels, said transverse channel, said check valves and said elastic pad between said upper cover and said sole; and an inner sole having a plurality of perforations formed in a front portion thereof corresponding to said filter of said upper cover and corresponding to said front ports of said longitudinal channels of said sole embedded on said upper cover;

said longitudinal holes of said elastic pad defining a pumping chamber for sucking air from a wearer's toe portions and for discharging the air through the check valves and discharge ports in said sole, said elastic pad serving as a shock absorber.

2. A footwear according to claim 1, wherein said elastic pad is made of elastomer materials.

3. A footwear according to claim 1, wherein said longitudinal holes in the elastic pad define a pumping chamber of an air ventilation system of the footwear.

4. A footwear according to claim 1, wherein said plurality of longitudinal holes in said pad include an upper row of upper holes and a lower row of lower holes, said upper holes being interlacedly positioned above said lower holes so that each upper hole is not projectively aligned with each said lower hole.

5. A footwear according to claim 1, wherein said check valve includes an elastic cylindrical member having its one end formed as an inlet opening and having its other end formed as an end cover, and a protection sleeve made of rigid material circumferentially disposed around said cylindrical member, said end cover opposite to said inlet opening being slitted to form a resilient lid resiliently closing or operatively opening an outlet or discharge opening along the slit formed on the end cover, thereby forming a check valve allowing an one-way air flow to be discharged through said slit of said resilient lid.

6. A footwear according to claim 5, wherein said resilient lid has a length of one thrid of the diameter of the end cover of said check valve.

7. A footwear according to claim 1, wherein said elastic pad is substituted with a plurality of longitudinal elastic tubes overlapped together each tube having its innermost end closed and having its outer end open and communicated with said transverse ventilation channel.

* * * * *